US007459059B2

(12) United States Patent
Keiser et al.

(10) Patent No.: US 7,459,059 B2
(45) **Date of Patent: *Dec. 2, 2008**

(54) USE OF SYNTHETIC METAL SILICATES FOR INCREASING RETENTION AND DRAINAGE DURING A PAPERMAKING PROCESS

(75) Inventors: Bruce A. Keiser, Naperville, IL (US); Laura M. Sherman, Naperville, IL (US)

(73) Assignee: Nalco Company, Naperville, IL (US)

( * ) Notice: Subject to any disclaimer, the term of this patent is extended or adjusted under 35 U.S.C. 154(b) by 521 days.

This patent is subject to a terminal disclaimer.

(21) Appl. No.: 11/231,662

(22) Filed: Sep. 21, 2005

(65) Prior Publication Data

US 2007/0062660 A1 Mar. 22, 2007

(51) Int. Cl.
*D21H 11/00* (2006.01)

(52) U.S. Cl. ..... 162/181.6; 162/183; 162/164.1; 162/168.3; 162/158

(58) Field of Classification Search ..... 162/181.6, 162/183, 164.1, 168.3, 175, 164.3, 158
See application file for complete search history.

(56) References Cited

U.S. PATENT DOCUMENTS

| | | | |
|---|---|---|---|
| 4,193,775 | A | 3/1980 | Wang |
| 4,610,801 | A | 9/1986 | Matthews et al. |
| 4,750,974 | A | 6/1988 | Johnson |
| 4,753,710 | A | 6/1988 | Langley et al. |
| 5,015,334 | A | 5/1991 | Derrick |
| 5,071,512 | A | 12/1991 | Bixler et al. |
| 5,178,730 | A | 1/1993 | Bixler et al. |
| 5,194,120 | A | 3/1993 | Peats et al. |
| 5,277,764 | A | 1/1994 | Johnasson et al. |
| 5,571,379 | A | 11/1996 | Derrick |
| 5,989,714 | A | 11/1999 | Drummond |
| 6,183,650 | B1 | 2/2001 | Drummond |
| 6,270,627 | B1 | 8/2001 | Keiser et al. |
| 6,310,104 | B1 | 10/2001 | Keiser et al. |
| 6,372,089 | B1 | 4/2002 | Keiser et al. |
| 6,712,934 | B2 | 3/2004 | Ahlgren et al. |
| 2005/0161183 | A1 | 7/2005 | Corvarrubias |

*Primary Examiner*—Mark Halpern
(74) *Attorney, Agent, or Firm*—Peter A. DiMattia; Michael B. Martin

(57) ABSTRACT

The invention discloses a paper or paperboard produced from a slurry comprising cellulose fibers and an effective amount of SMS. In addition, a method for increasing retention and dewatering during the papermaking process is also disclosed. The method involves the addition of an effective amount of SMS to said papermaking process.

23 Claims, No Drawings

USE OF SYNTHETIC METAL SILICATES FOR INCREASING RETENTION AND DRAINAGE DURING A PAPERMAKING PROCESS

FIELD OF THE INVENTION

This disclosure relates to a method for increasing retention and dewatering during a papermaking process through the addition of a synthetic metal silicate to the papermaking process, as well as paper or paperboard produced from a synthetic metal silicate.

BACKGROUND

Retention and dewatering systems for use in papermaking currently utilize any component or combination of components from the following list: flocculant, coagulant, and inorganic particulate. When these systems are added to an aqueous slurry containing cellulose fibers, fines, fillers, and other additives, and subsequently introduced onto a paper machine, sheet formation is facilitated with observed improvements in the retention and dewatering. Throughout the recent history of papermaking several different inorganic particulates have been used as part of the retention and dewatering system. The inorganic particulate has ranged from colloidal silica or silica sols, modified silica sols, and borosilicate sols, to naturally occurring smectite clays, used singly or in combination with each other. Even so, there is a need for a new synthetic inorganic particulate that provides even better retention and dewatering without sacrificing the properties of the paper or paperboard.

SUMMARY OF THE INVENTION

The present invention provides for a paper or paperboard produced from a slurry comprising cellulose fibers and an effective amount of SMS.

The present invention also provides for a method for increasing retention and dewatering during the papermaking process, comprising the step of: adding an effective amount of SMS to said papermaking process.

BRIEF DESCRIPTION OF THE DRAWINGS

Detailed Description of the Invention

"SMS" means a synthetic metal silicate of the following formula: $(Mg_{3-x}\ Li_x)\ Si_4\ Na_{0.33}\ [F_y\ (OH)_{2-y}]_2\ O_{10}$, wherein: x=0 to 3.0; and y=0.01 to 2.0.

The SMS of the present invention can be made by combining simple silicates and lithium, magnesium, and fluoride salts in the presence of mineralizing agents and subjecting the resulting mixture to hydrothermal conditions. As an example, one might combine a silica sol gel with magnesium hydroxide and lithium fluoride in an aqueous solution and under reflux for two days to yield SMS. (See Industrial & Chemical Engineering Chemistry Research (1992), 31(7), 1654, which is herein incorporated by reference). One can also obtain the SMS directly from Nalco Company, Naperville, Ill. 60563.

"Papermaking process" means a method of making paper products from pulp comprising forming an aqueous cellulosic papermaking furnish, draining the furnish to form a sheet and drying the sheet. The steps of forming the papermaking furnish, draining and drying may be carried out in any conventional manner generally known to those skilled in the art.

"COD" means chemical oxygen demand

"GCC" means ground calcium carbonate.

"HWK" means hardwood bleached kraft.

"MCL" means mean chord length.

"SWK" means softwood bleached kraft.

"TMP" means thermal mechanical pulp.

"PCC" means precipitated calcium carbonate.

"CTMP" means chemical thermal mechanical pulp.

"GWD" means groundwood pulp.

As stated above, the present invention provides for a method for increasing retention and dewatering during the papermaking process, comprising the step of adding an effective amount of SMS. SMS maybe added to said papermaking process as solid or as a dispersion. In one embodiment, the SMS is added to a slurry located in said papermaking process. The slurry may comprise one or more cellulose fibers, fines and fillers dispersed in water.

In another embodiment, the effective amount of SMS added to said slurry is from 0.001 to 6 kg/T based upon the solids in the slurry or from 0.01 to 3 kg/T based on solids in the slurry.

In another embodiment, a colloidal silica is added to the slurry of said papermaking process. In a further embodiment, the weight ratio of colloidal silica to SMS is 0.01:1 to 100:1.

In another embodiment, a colloidal borosilicate is added to said slurry of said papermaking process. In a further embodiment, the weight ratio of colloidal borosilicate to SMS is 0.01:1 to 100:1.

In another embodiment, one or more polymers may be added to the slurry prior to, after, or in combination with the addition of said SMS. The polymers may be selected from the group consisting of the following types of polymers: cationic; anionic; non-ionic; zwiterionic; and amphoteric. In a further embodiment, the cationic polymers are selected from the group consisting of: naturally occurring carbohydrates; synthetic linear, branched, cross-linked flocculants; organic microparticulates; copolymers of acrylamide and diallydimethylammonium chloride; copolymers of dimethyl aminoethyl (meth)acrylate and acrylamide; copolymers of (meth) acrylic acid and acrylamide; copolymers of dimethyl aminoethyl (meth)acrylate and acrylamide; copolymers of dimethyl aminoethyl (meth)acrylate-methyl chloride quat and acrylamide; and terpolymers of dimethyl aminoethyl (meth)acrylate, acrylamide, and (meth)acrylic acid. An example of the organic microparticles referred to above is found in U.S. Pat. No. 5,274,055, Honig and Harris, which is herein incorporated by reference. In yet a further embodiment, the type of naturally occurring carbohydrates are selected from the group consisting of: guar gum and starch.

In a further embodiment, the anionic polymers are selected from the group consisting of: homo and copolymers of acrylic acid, and copolymers of methacrylamide 2-acrylamido-2-methlypropane sulfonate with acrylamide or methacrylamide.

In a further embodiment, the non-ionic polymers are selected from the group consisting of: polyethylene oxide, and polyacrylamide.

In another embodiment, one or more organic coagulants, inorganic coagulants, or combination thereof are added to said slurry. In yet a further embodiment, the organic coagulants are polyalkylenepolyamines prepared from epichlorohydrindimethylamine and ethyleneimines. In yet a further embodiment, the inorganic coagulants are selected from the group consisting of: alum; polyaluminum chloride and polyaluminum silicate sulfate.

In another embodiment, the invention comprises a method for increasing retention and dewatering during a papermaking process comprising the steps of adding an effective amount of SMS, wherein said SMS is added to a slurry of said papermaking process; and providing a paper or paperboard machine and forming a dry paper or paperboard. In a further embodiment, the SMS is added to said slurry prior to dewatering and forming a dry paper or paperboard on said paper or paperboard machine The present invention will be further described in the following examples, which show various application methods, but are not intended to limit the invention prescribed by the appended claims.

EXAMPLE 1

A synthetic lightweight coated thin stock having a consistency of 0.7 wt % was prepared. The thin stock solids consist of 50 dry wt % hydrogen peroxide bleached mixed TMP, 25 dry wt % bleached softwood kraft, 14.5 wt % kaolin clay, and 10.5 wt % ultrafine GCC. The mixed TMP consists of 80 wt % hardwood and 20 wt % softwood fiber. The bleached softwood kraft is dry lap pulp purchased from Weldwood, Hinton Canada. The softwood kraft was a repulped in deionized water and beaten to a 360 mL Canadian Standard Freeness. Kaolin clay was purchased from Imerys, 100 Mansell Court East, Suite 300, Roswell, G 30074, while the GCC was obtained from Omya North America, 100 North Point Center East, Suite 310, Alpharetta, Ga. 30022. The thin stock was produced from the corresponding thick stocks by using the bleached mixed TMP filtrate and deionized water containing 2.0 mM calcium, 0.23 mM magnesium, 4.9 mM sulfate and 21.8 mM sodium. An appropriate quantity of salt solution was used with the TMP filtrate to yield the thin stock at 0.7 wt % consistency with 950 mg/l COD, a pH of 8.2, and a conductivity of 2500 microS/cm.

The cationic starch used herein is Solvitose N and is available from Avebe, Prins Hendrikplein 20, 9641 GK Veendam, The Netherlands. The Commercial Product used in this example is CP 1131, which is a non-fluoride synthetic hydrous sodium lithium metal silicate and can be obtained from Rockwood Specialties, Ltd, Widnes, Cheshire, United Kingdom. The Nalkat® 2020 and 61067 are commercial products, which can be obtained from Nalco Company, 1601 West Diehl Road, Naperville, Ill. 60563.

Flocculation activity was measured by Focused Beam Reflectance Measurement (FBRM), also known as Scanning Laser Microscopy or SLM, using the Lasentec™ M500 (Lasentec, Redmond, Wash.). A description of the theory behind the operation of the FBRM can be found in Preikschat, F. K. and Preikschat, E., "Apparatus and method for particle analysis," U. S. Patent Office, U.S. Pat. No. 4,871,251, 1989, which is herein incorporated by reference. The following references are incorporated by reference and describe in detail how this technique is used to measure performance and how it correlates to paper machine experience: Gerli, A., Keiser, B. A., and Surya, P. I., "The use of focused beam reflectance measurement in the development of a new nanosize particle," *Appita J.,* 54(1), 36-40(2001); Clemencon, I. and Gerli, A., "The effect of flocculant/microparticles retention programs on floc properties," *Nord. Pulp Pap. Res. J.,* 14(1), 23-29(1999); Gerli, A., Oosterhof, F., and Keiser, B. A., "An inorganic nanosize particle—part of a new retention/dewatering system," *Pap. Technol.* (Bury, U. K.), 40(8), 41-45 (1999). The change in the number average chord length or MCL of the thin stock as a function of time is used to characterize a flocculation response. The change in MCL caused by addition of particulate correlates with the additive performance in the papermaking process with the greater the ΔMCL (change in mean chord length) indicating better performance. The peak change in MCL gives a representation of the speed and extent of flocculation under the shear conditions present.

A 300 mL of synthetic light weight coated furnish was poured into a 500 mL glass beaker and place it onto the Focused Beam Reflectance Measurement (FBRM) stand. Mixing was started at 710 rpm. Coagulant, starch, flocculant and particulate were added as outlined in table entitled "Addition Sequence."

Addition Sequence

| Time | Event |
|---|---|
| 0 | start mixing at 710 rpm |
| 6 | add 4 kg/ton Nalkat ® 2020 |
| 21 | add 5 kg/ton Solvitose-N starch |
| 51 | add 1.5 kg/ton 61067 |
| 96 | add particulate |

In this example, the performance of the SMS is compared to that of the Commercial Product. The change in mean chord is compared for the samples. The results are illustrated in the following table.

| Commercial Product | | SMS | |
|---|---|---|---|
| Dose kg/ton | Delta MCL | Dose, kg/ton | Delta MCL |
| 0 | 0 | 0 | 0 |
| 0.5 | 0.56 | 0.5 | 4.35 |
| 1.0 | 0.78 | 1.0 | 5.03 |
| 1.5 | 1.09 | 1.5 | 5.62 |

Note:
The inorganic particulate is added on an actives basis.

As can be seen from this data, the SMS provides significantly larger flocculation response compared to the Commercial Product. This larger flocculation response of the SMS has been shown to correlate with greater fines particle retention during papermaking.

EXAMPLE 2

A blended synthetic alkaline fine paper thin stock at 0.5 wt % consistency was prepared. The solids of the thin stock are composed of 32 wt % SWK, 48 wt % HWK, and 20% ultrafine GCC. The SWK is prepared from dry lap obtained from a mill located in Alberta Canada, repulped in deionized water at 2-4 wt % consistency and beaten to a 360 mL Canadian Standard Freeness (CSF). The HWK was prepared from dry lap originating from a Northern US mill, repulped in deionized water at 2-3 wt % consistency, and beaten to 360 mL CSF. The GCC was Ultrafine obtained from Omyafil. The corresponding thick stocks and GCC were combined and diluted with deionized water containing 1.5 mM calcium, 0.74 mM magnesium, 2.2 mM sodium, 2.99 mM chloride, 0.75 mM sulfate and 2.2 mM bicarbonate. The thin stock was 0.5 wt % consistency, with a pH of 8.1 and a conductivity of 600 microS/cm.

The comparative particulate in this example is Laponite® RD available commercially from Rockwood Specialties, Ltd, Widnes, Cheshire, United Kingdom. The Laponite® RD is a synthetic hydrous sodium lithium magnesium silicate which is identified by CAS No. 533320-86-8 and has a typical chemical composition based on weight percent of: $SiO_2$ 59.5; MgO 27.5; $Li_2O$ 0.8; and $Na_2O$ 2.8.

A 300 mL of synthetic alkaline fine paper slurry was poured into a 500 mL glass beaker and place it onto the Focused Beam Reflectance Measurement (FBRM) stand. Start mixing at 710 rpm. Starch, flocculent and inorganic particulate were added in the following addition sequence:

| Addition Sequence | |
|---|---|
| Time | Event |
| 0 | start mixing at 710 rpm |
| 15 | add 5 kg/ton Solvitose-N starch |
| 30 | add 2 kg/ton 61067 |
| 75 | add particulate |
| 120 | stop |

The FBRM application is described in the previous example. In this example, the SMS is compared to Laponite RD. The results are summarized in the following table.

| | ΔMCL | |
|---|---|---|
| Dose kg/ton | Laponite RD | SMS |
| 0.25 | 5.92 | — |
| 0.50 | 7.74 | 11.45 |
| 0.75 | — | 12.5 |
| 1.00 | 10.86 | 13.81 |
| 1.50 | 12.32 | 15.47 |

Note:
The inorganic particulate is added on an actives basis.

As can be seen from this data, the SMS provides a significantly larger flocculation response compared to the previously existing and commercially available synthetic hydrous sodium lithium magnesium silicate known as Laponite RD. This larger flocculation response generated by SMS indicates greater fines retention during papermaking compared to what is currently available.

EXAMPLE 3

In this example, the dewatering performance of the SMS is compared to that of a commercially available material in a light weight coated stock obtained from a mill in the Canada. The make-up of the stock fiber is outlined in the table below. The cationic starch used in this study was Cato 31, which is commercially available from National Starch, 742 Grayson Street Berkeley, Calif. 94710-2677. The PCC is produced at the mill and was obtained therefrom. Nalkat® 7655 and Nalco 7526 are commercial products available from Nalco Company, 1601 West Diehl Road, Naperville, Ill. 60563. The Commercial Product used in this example is CP 1131, which is a non-fluoride synthetic hydrous sodium lithium metal silicate and can be obtained from Rockwood Specialties, Ltd, Widnes, Cheshire, United Kingdom.

TABLE

| Stock fiber composition (wt %) for Example 3 | |
|---|---|
| Fiber Source | |
| Coated Broke | 19% |
| Uncoated Broke | 6% |
| Mixed Fiber | 75% |
| CTMP Peroxide Bleached | 47% |

TABLE-continued

| Stock fiber composition (wt %) for Example 3 | |
|---|---|
| Fiber Source | |
| GWD Peroxide Bleached | 4% |
| CTMP | 15% |
| Softwood Bleached Kraft | 34% |
| PCC | 3% |

The blended fiber and filler solids were diluted with white water to 0.7 wt % consistency.

Vacuum dewatering analysis of the products was carried out using the Vacuum Drainage Tester (Herein referred to as VDT).

The VDT is a pad-forming device, meaning a cellulose fiber containing slurry is drained under vacuum onto a filter paper or wire resulting in the formation of a pad. As such, it is similar in principle of operation and dewatering information provided, to other vacuum dewatering devices described in the literature (e.g. see Forsberg, S. and Bengtsson, M., "The Dynamic Drainage Analyzer, (DDA)," Proceedings Tappi 1990 Papermaker's Conference, pp. 239-45, Atlanta, Ga., Apr. 23-25, 1990, which is incorporated by reference). The VDT used herein, identified as VDT+, which is available from Nalco Company, 1601 West Diehl Road, Naperville, Ill., 60563, was modified so that mixing of chemical additives with the slurry was done in an upper chamber of the instrument. Subsequently, the treated slurry is transferred by gravity from the upper mixing chamber to the vacuum dewatering chamber. The dewatering rate, in mL/sec was calculated by determining the time necessary to collect 400 mL of filtrate or white water. The operational conditions are summarized in the table below.

TABLE

| VDT+ Test Conditions | | |
|---|---|---|
| Sample Size: | 500 mLs of 0.7 wt % consistency | |
| Dewatering Time (sec) | Time to 400 mLs | |
| Vacuum: | 20 in. Hg | |
| Chemical Additive | 1100 | |
| Mixer Speed (RPM) | | |
| Temperature of slurry | 68° F. | |
| Filter Paper: | Ahlstrom 1278 | |
| Addition Sequence (seconds): | t = 0 | start |
| | t = 5 | add 5 kg/ton starch |
| | t = 10 | add 0.5 kg/ton Nalkat ® 7655 |
| | t = 20 | add 2 kg/ton Nalco 7526 |
| | t = 25 | add inorganic particulate |
| | t = 27 | vacuum on |
| | t = 30 | pull paddle, drain slurry |

The results of the dewatering comparison are shown in the table below. As can be seen a higher dewatering rate, i.e. 15.7 mL/sec, was obtained with the inorganic particulate of this invention, the SMS, as compared to Commercial Product.

| Product | Dose | Drainage Rate, mL/sec |
|---|---|---|
| Commercial Product | 1 kg/ton | 13.4 |
| SMS | 1 kg/ton | 15.7 |

Note:
The inorganic particulate is added on an actives basis.

What is claimed is:

1. Paper or paperboard produced from a slurry comprising cellulose fibers and an effective amount of synthetic metal silicate, wherein said synthetic metal silicate has the following formula: $(Mg_{3-x}Li_x)Si_4Na_{0.33}[F_y(OH)_{2-y}]_2O_{10}$, wherein: x=0 to 3.0; and y=0.01 to 2.0.

2. The method of claim 1, wherein said effective amount of synthetic metal silicate is from about 0.001 to about 6 kg/T based upon the solids in the slurry.

3. The method of claim 1, wherein said effective amount of synthetic metal silicate is from about 0.01 to about 3 kg/T based upon the solids in the slurry.

4. A method for increasing retention and dewatering during a papermaking process, comprising the step of: adding an effective amount of synthetic metal silicate to said papermaking process, wherein said synthetic metal silicate has the following formula: $(Mg_{3-x}Li_x)Si_4Na_{0.33}[F_y(OH)_{2-y}]_2O_{10}$, wherein: x=0 to 3.0; and y=0.01 to 2.0.

5. The method of claim 4, wherein said synthetic metal silicate is added to a slurry that is located in said papermaking process.

6. The method of claim 5, further comprising the steps of: providing a paper or paperboard machine and dewatering said slurry and forming a dry paper or paperboard on said paper or paperboard machine.

7. The method of claim 6, wherein said synthetic metal silicate is added to said slurry prior to dewatering and forming a dry paper or paperboard.

8. The method of claim 5, wherein said slurry comprises one or more cellulose fibers, fines and fillers dispersed in water.

9. The method of claim 5, further comprising the addition of one or more polymers to said slurry prior to, after or in combination with the addition of said synthetic metal silicate.

10. The method of claim 9, wherein said polymers are selected from the group consisting of: cationic; anionic; nonionic; zwitterionic; and amphoteric polymers.

11. The method of claim 10, wherein said cationic polymers are selected from the group consisting of: naturally occurring carbohydrates; synthetic linear, branched, or cross-linked flocculants; organic microparticulates; copolymers of acrylamide and diallydimethylammonium chloride; copolymers of dimethyl aminoethyl (meth)acrylate and acrylamide; copolymers of (meth)acrylic acid and acrylamide; copolymers of dimethyl aminoethyl (meth)acrylate and acrylamide; copolymers of dimethyl aminoethyl (meth)acrylate-methyl chloride quat and acrylamide; and terpolymers of dimethyl aminoethyl (meth)acrylate, acrylamide, and (meth)acrylic acid.

12. The method of claim 10, wherein said naturally occurring carbohydrates are selected from the group consisting of: guar gum, and starch.

13. The method of claim 10, wherein said anionic polymers are selected from the group consisting of: homo and copolymers of acrylic acid; and copolymers of methacrylamide 2-acryloamido-2-methlypropane sulfonate with acrylamide or methacrylamide.

14. The method of claim 10, wherein said non-ionic polymers are selected from the group consisting of: polyethylene oxide and polyacrylamide.

15. The method of claim 5, further comprises the addition of one or more organic coagulants, inorganic coagulants, or combination thereof to said slurry.

16. The method of claim 15, wherein said organic coagulants are polyalkylenepolyamines prepared from epichlorohydrindimethylamine and ethyleneimines.

17. The method of claim 15, wherein said inorganic coagulants are selected from the group consisting of: alum; polyaluminum chloride; and polyaluminum silicate sulfate.

18. The method of claim 5, further comprising the addition of colloidal silica to said slurry.

19. The method of claim 18, wherein the weight ratio of colloidal silica to synthetic metal silicate is 0.01:1 to 100:1.

20. The method of claim 5, further comprising the addition of colloidal borosilicate to said slurry.

21. The method of claim 20, wherein the weight ratio of colloidal borosilicate to synthetic metal silicate is 0.01:1 to 100:1.

22. The method of claim 5, wherein said effective amount of synthetic metal silicate is from about 0.001 to about 6 kg/T based upon the solids in the slurry.

23. The method of claim 5, wherein said effective amount of synthetic metal silicate is from about 0.01 to about 3 kg/T based upon the solids in the slurry.

* * * * *